US007527399B2

(12) United States Patent
Feiereisen

(10) Patent No.: US 7,527,399 B2
(45) Date of Patent: May 5, 2009

(54) SELF-CONTAINED FULL LIGHT CUT-OFF LIGHT POLLUTION-FREE BULB

(76) Inventor: Thomas Feiereisen, 4191 Hampton Cir., Boulder, CO (US) 80301

( * ) Notice: Subject to any disclaimer, the term of this patent is extended or adjusted under 35 U.S.C. 154(b) by 0 days.

(21) Appl. No.: 11/890,060

(22) Filed: Aug. 3, 2007

(65) Prior Publication Data

US 2008/0285284 A1 Nov. 20, 2008

Related U.S. Application Data

(60) Provisional application No. 60/930,066, filed on May 14, 2007.

(51) Int. Cl.
*F21V 7/00* (2006.01)

(52) U.S. Cl. ..... 362/342; 362/290; 362/378

(58) Field of Classification Search ..... 362/342, 362/290, 253, 279, 311, 376, 377, 378, 312, 362/353, 354

See application file for complete search history.

(56) References Cited

U.S. PATENT DOCUMENTS 4,096,555 A * 6/1978 Lasker ..... 362/302
4,669,034 A * 5/1987 Bansbach et al. ..... 362/309
6,234,649 B1 * 5/2001 Katougi ..... 362/248
6,309,091 B1 * 10/2001 Weissman ..... 362/354

* cited by examiner

*Primary Examiner*—Laura Tso
(74) *Attorney, Agent, or Firm*—Ruth Eure

(57) ABSTRACT

The full light cut-off, light pollution-free, light bulb is a complete and self-contained bulb that is designed to replace standard light bulbs in standard light fixtures turning that standard light fixture into a full cut-off, light pollution-free fixture. The light bulb assembly is built around a light bulb, such as a compact florescent light bulb or a standard incandescent light bulb. Two variations are described. The first design is to replace standard compact florescent light bulbs or incandescent light bulbs mounted in an upward facing socket such as a lamp post or upward socket carriage light fixture. The second design is to replace standard compact florescent light bulbs or incandescent light bulbs mounted in a downward facing socket such as downward socket carriage light fixture. In both designs, the basic light bulb is enclosed in a transparent cylinder. Between the cylinder and the base bulb are a series of opaque, conical louvers arranged so as to provide full cut-off of the light emitted from the bulb in the horizontal direction and above the horizontal direction. Light emission from the bulb will in fact be limited to a cone-shaped volume below the light bulb fixture assembly. The upper end-cap of the cylinder in both designs may be opaque with a mirrored interior surface to aid in reflecting the light in the downward direction. The lower end-cap surface of the cylinder in both designs is transparent to allow maximum possible light transmission in the downward direction.

22 Claims, 11 Drawing Sheets

Prior Art unshielded light bulb (up-facing), standard carriage fixture, light post:

light trespass, light pollution, wasted energy

Self-contained, full light cut-off, light pollution-free, light bulb (up-facing), standard carriage fixture, light post:

ground illumination, contained light, energy efficient

Prior Art

Prior Art unshielded light bulb shown in standard globe fixture mounted on a light post:

light trespass, light pollution, wasted energy

Self-contained, full light cut-off, light pollution-free, light bulb shown in standard globe fixture mounted on a light post:

ground illumination, contained light, energy efficient

SELF-CONTAINED FULL LIGHT CUT-OFF LIGHT POLLUTION-FREE BULB

CLAIM OF PRIORITY

This patent application claims priority under 35 USC 119 (e)(1) from U.S. Provisional Patent Application Ser. No. 60/930,066, filed May 14, 2007, of common inventorship herewith entitled, "Full cut-off, light pollution-free bulb," which is incorporated herein in its entirety.

FIELD OF THE INVENTION

The present invention relates to the field of light fixtures and more specifically to the field of light fixture modification designed to eliminate light pollution and light trespass and in doing so, reduce power usage and enhance light efficiency.

BACKGROUND OF THE INVENTION

Much to the dismay of amateur and professional astronomers as well as many within the general public, the problem of light pollution and light trespass has increased with the development of land and increased population densities in urban and suburban areas. In many areas, the night sky is no longer dark. A halo of lost light hangs over many urban and suburban areas. Many homeowners, city planners and architects continue the installation of multiple, poorly-shielded or non-shielded outdoor lighting fixtures for the illumination of residential structures, commercial buildings, streets, and parking lots. Therefore, as more improper light fixtures are installed, the night sky is slowly becoming less dark.

Many municipalities across the U.S. currently require new outdoor illumination to meet full light cut-off specifications through local ordinance (i.e., Boulder, Colo.; Madison, Wis.; Tucson, Ariz.; and San Diego, Calif.). Typically, municipal ordinances also address existing non-compliant lighting with a requirement for retrofit by a specific future date. Historically, the problem has been solved with the use of a shielded fixture, or light shade in which a bulb is inserted.

U.S. Pat. No. 7,083,307 entitled "Light Directing Assembly for Preventing Light Pollution" to Galgon and D'Andrea describes a light fixture for a downward facing light bulb which comprises a shield at the top of the fixture where the bulb is inserted and a shade like apparatus which wraps around the bulb.

The present invention, however, takes a different approach, providing a self-contained, sealed bulb assembly which requires no additional fixture or shade to transform a standard lighting apparatus to one which produces no light pollution and prevents light trespass. Simply install the present invention in a standard light fixture the same as you would any light bulb and the present invention converts the non-compliant light fixture into a compliant fixture.

SUMMARY OF THE INVENTION

The present invention relates to a device for controlling direction of light emitted from a standard electrical light fixture thus eliminating light pollution. No modification of the light fixture is needed other than installation of this self-contained, full cut-off light pollution free bulb. With the installation of this invention in a standard light fixture, the light emitted from that fixture remains directed toward the ground, thus producing a cone of light around the fixture. Light is cut off below the horizontal plane and directed where needed rather than lost to distant surroundings. Light trespass is avoided and reduced power usage is achieved by putting the light where needed.

It is an object of the present invention to provide a full cut-off, light pollution-free light bulb.

It is a further object of the present invention to provide a full cut-off, light pollution-free light bulb containing louvers constructed within the bulb assembly. The invention is complete, self-contained and sealed and is designed to replace standard light bulbs in standard fixtures, thereby transforming a standard light fixture into a light pollution-free fixture. The light bulb assembly of the present invention is based upon a standard compact florescent light bulb or a standard incandescent bulb. The standard bulb is surrounded by conical light-directing louvers and encased in a transparent, sealed cylinder. The complete unit will be only slightly larger than the base bulb and thus useable in most standard light fixtures.

It is an object of the present invention to provide a full cut-off, light pollution-free light bulb for use in upward facing light fixtures.

With opposite orientation of the internal louvers and end caps, it is a further object of the present invention to provide a full cut-off, light pollution-free light bulb for use in downward-facing light fixtures.

It is a further object of the present invention to provide a full cut-off, light pollution-free light bulb having as few as one louver.

It is a further object of the present invention to provide a full cut-off, light pollution-free light bulb having a multiplicity of louvers.

It is a further object of the present invention to provide a full cut-off, light pollution-free light bulb having ten or more louvers.

It is a further object of the present invention to provide a full cut-off, light pollution-free light bulb having any number of louvers which achieves full cut-off of light in the unwanted direction.

It is a further object of the present invention to provide a full cut-off, light pollution-free light bulb having essentially parallel louvers angled and spaced appropriately to achieve full cut-off in various designs.

It is a further object of the present invention to provide a full cut-off, light pollution-free light bulb utilizing a compact fluorescent bulb.

It is a further object of the present invention to provide a full cut-off, light pollution-free light bulb utilizing an incandescent bulb.

It is a further object of the present invention to provide a full cut-off, light pollution-free light bulb utilizing any light bulb.

DETAILED DESCRIPTION OF THE INVENTION

Figure 2:
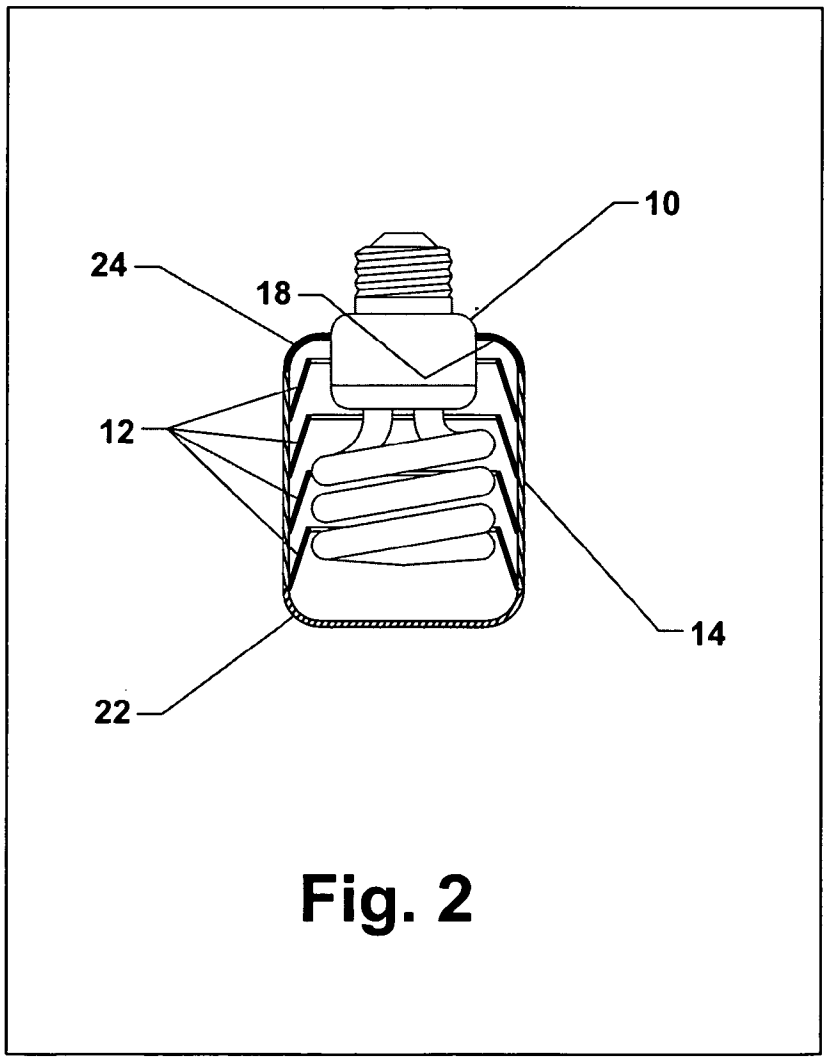
FIG. 2 shows a side view of the bulb of the present invention for a compact fluorescent bulb for use in a downward facing fixture having 4 louvers.

The full light cut-off, light pollution-free light bulb of the present invention is a complete, self-contained and sealed bulb that is designed to replace a standard light bulb in a standard light fixture transforming that light fixture into a full cut-off, light pollution-free fixture. The light bulb assembly is built around a compact fluorescent bulb, standard incandescent bulb, or any other light bulb.

In a preferred embodiment, the bulb is mounted in an upward facing fixture.

In an alternative preferred embodiment the bulb is mounted in a downward facing fixture.

The details of this novel bulb assembly are clearly described in the following detailed description and are shown in the accompanying drawings. In the description and the drawings, the same numbers refer to the same elements throughout.

For the sake of convenience, below is set forth a table which lists the drawing elements with their corresponding numbers.

| | |
|---|---|
| 10 | Light bulb |
| 12 | Fixed conical louvers |
| 14 | Transparent cylinder |
| 16 | Upper cap for upward facing bulb |
| 18 | Mirrored surface coating |
| 20 | Lower cap for upward facing bulb |
| 22 | Lower cap for downward facing bulb |
| 24 | Upper cap for downward facing bulb |
| 26 | Opaque surface coating |

Figure 1:
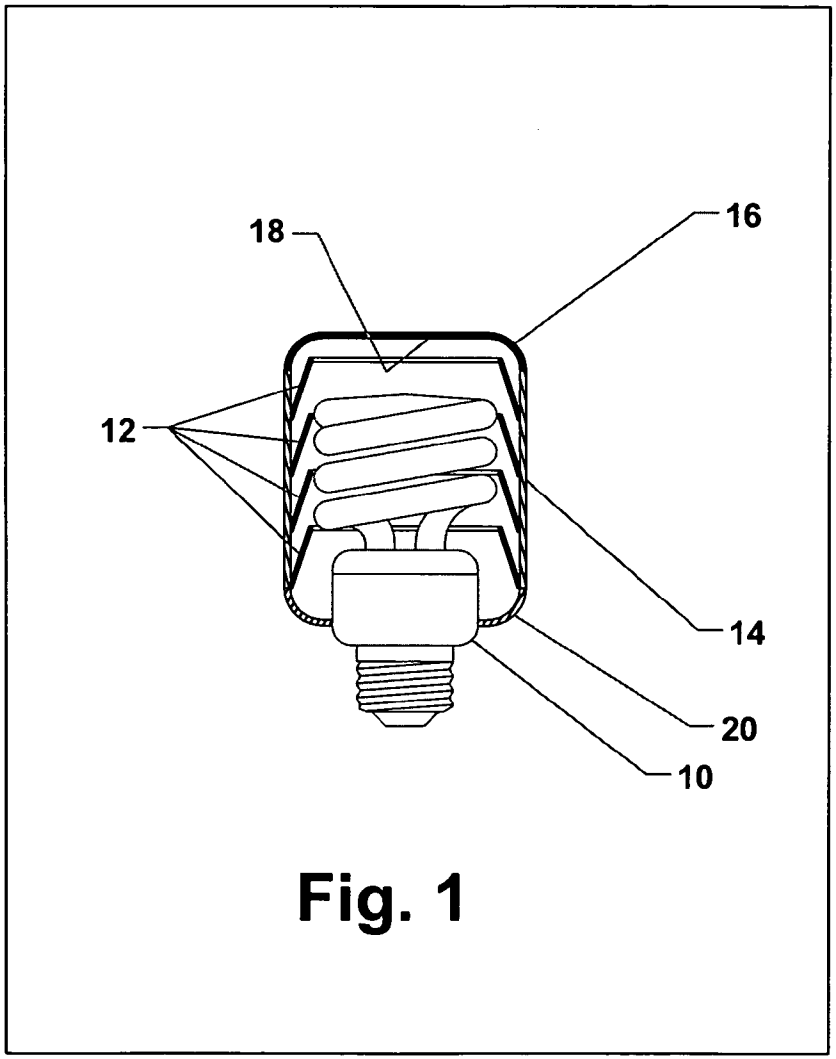
FIG. 1 shows a side view of the bulb of the present invention for a compact fluorescent bulb for use in an upward facing fixture having 4 louvers
Figure 4:
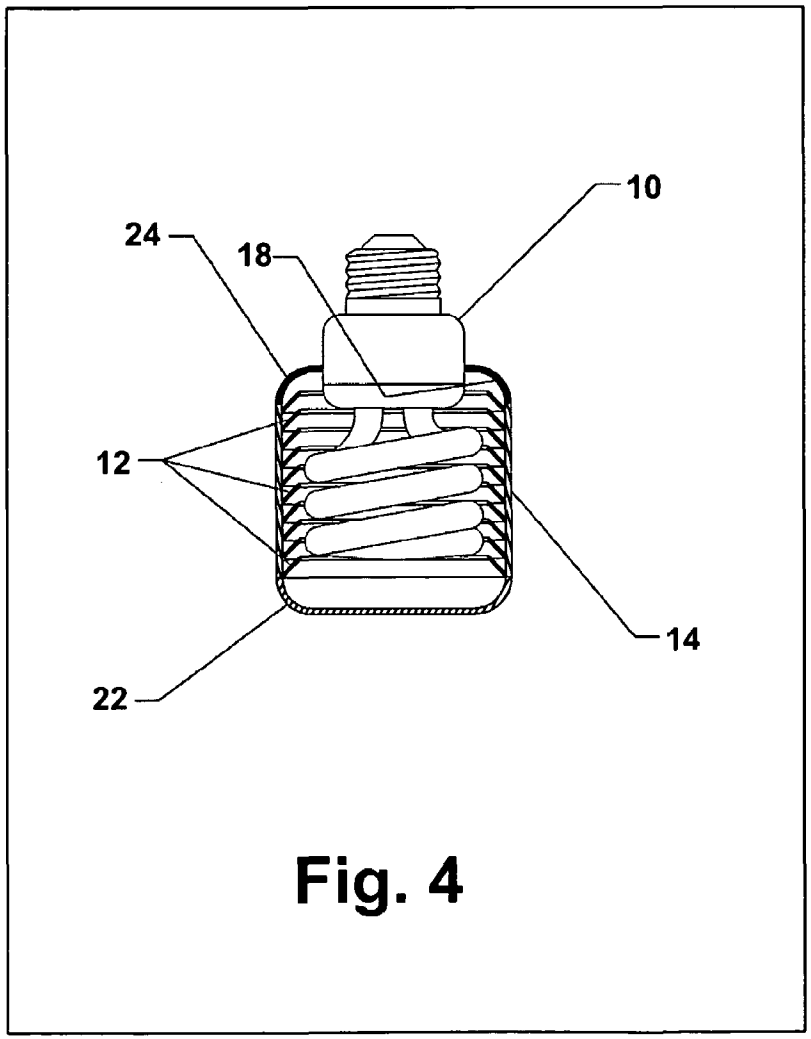
FIG. 4 shows a side view of the bulb of the present invention for a compact fluorescent bulb for use in a downward facing fixture having 10 louvers.
Figure 3:
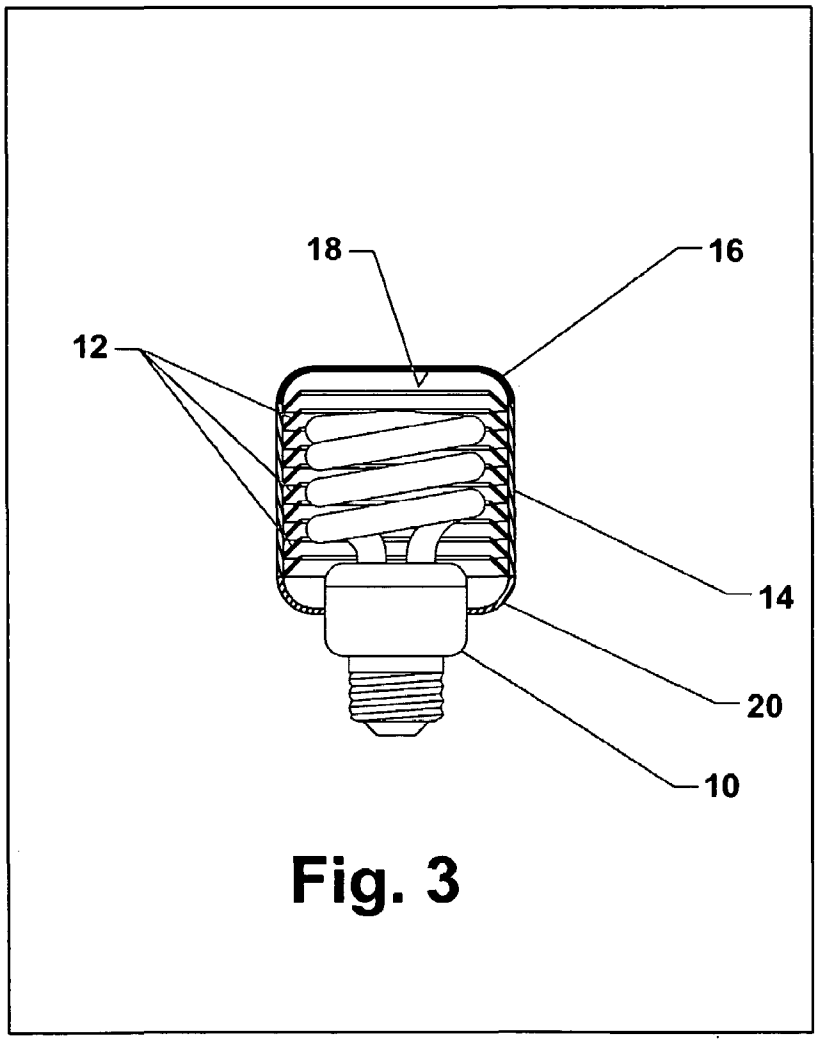
FIG. 3 shows a side view of the bulb of the present invention for a compact fluorescent bulb for use in an upward facing fixture having 10 louvers.
Figure 6:
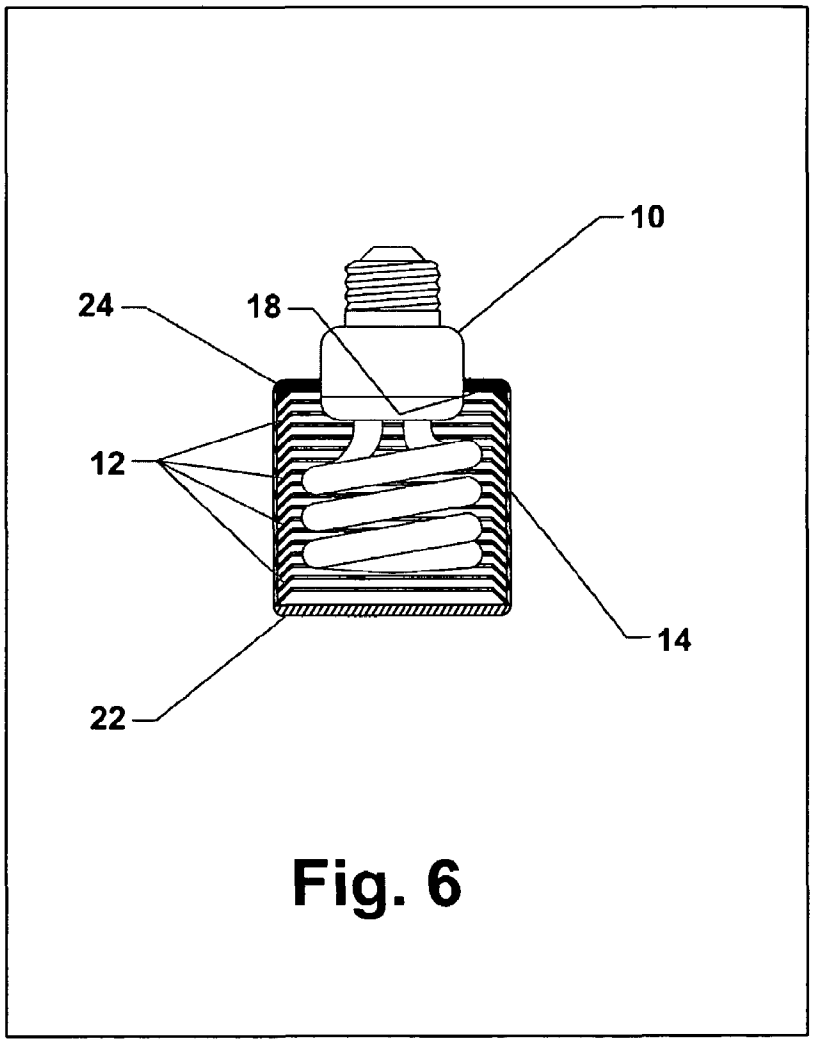
FIG. 6 shows a side view of the bulb of the present invention for a compact fluorescent bulb for use in a downward facing fixture having 17 louvers.
Figure 5:
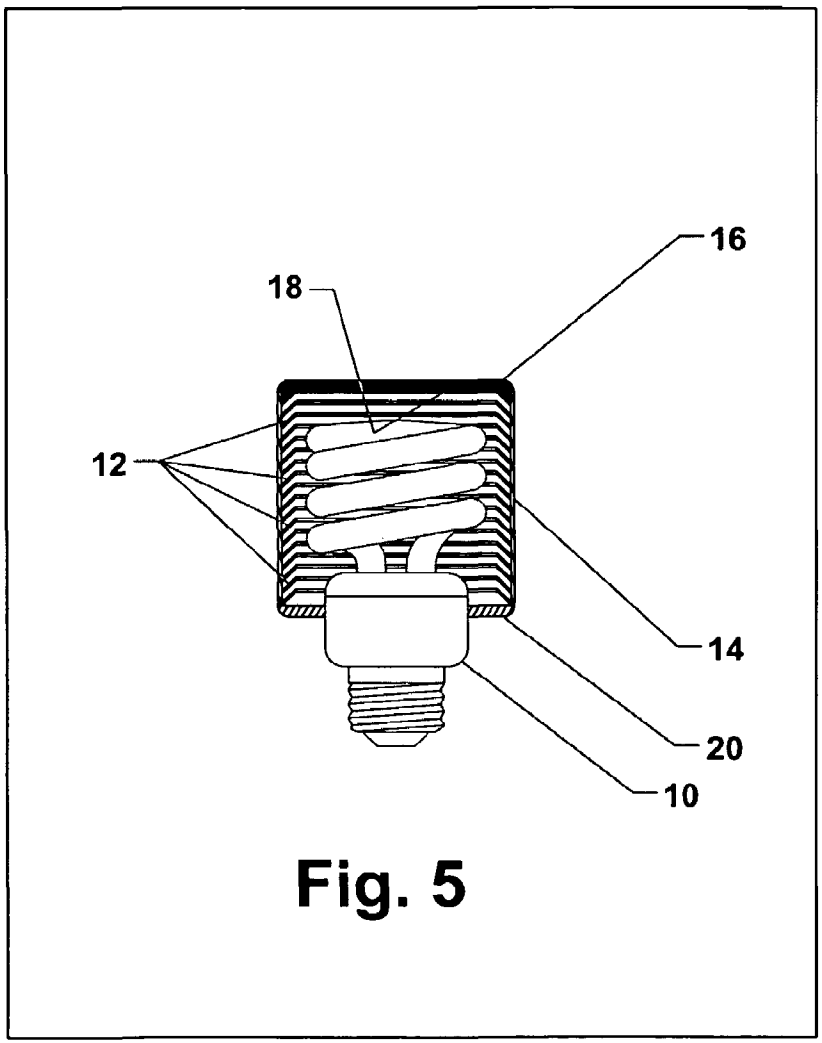
FIG. 5 shows a side view of the bulb of the present invention for a compact fluorescent bulb for use in an upward facing fixture having 17 louvers
Figure 8:
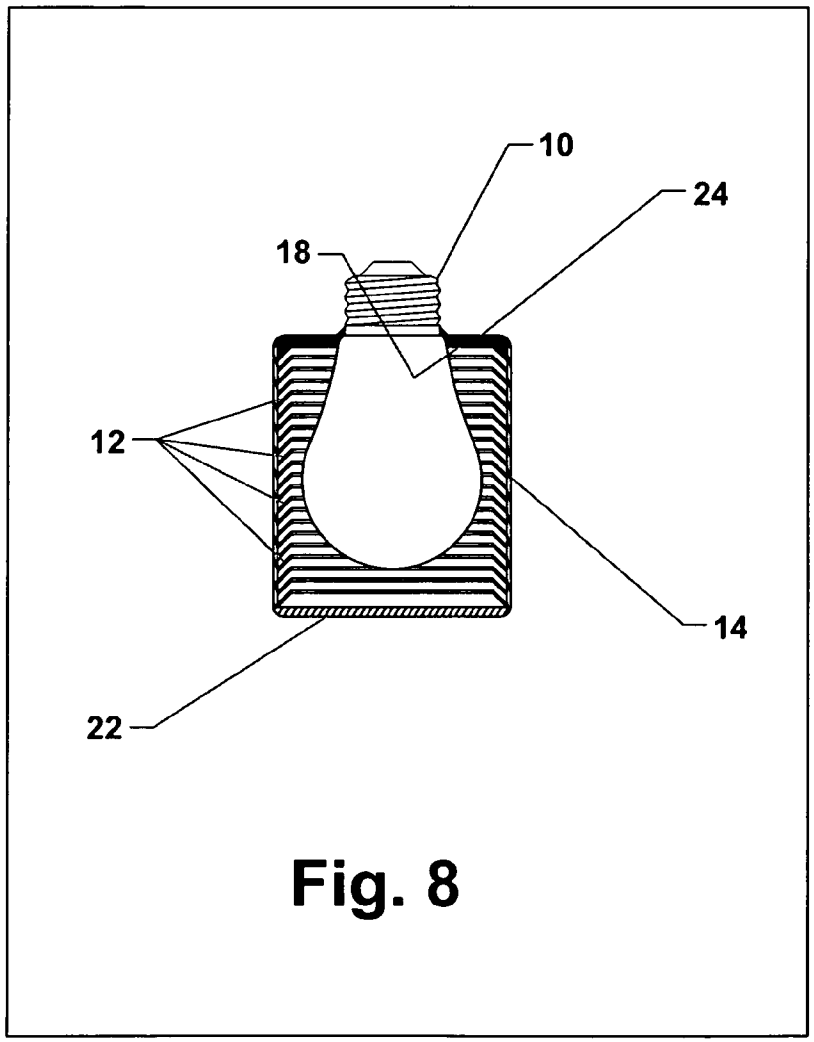
FIG. 8 shows a side view of the bulb of the present invention for an incandescent bulb for use in a downward facing fixture having 21 louvers.
Figure 7:
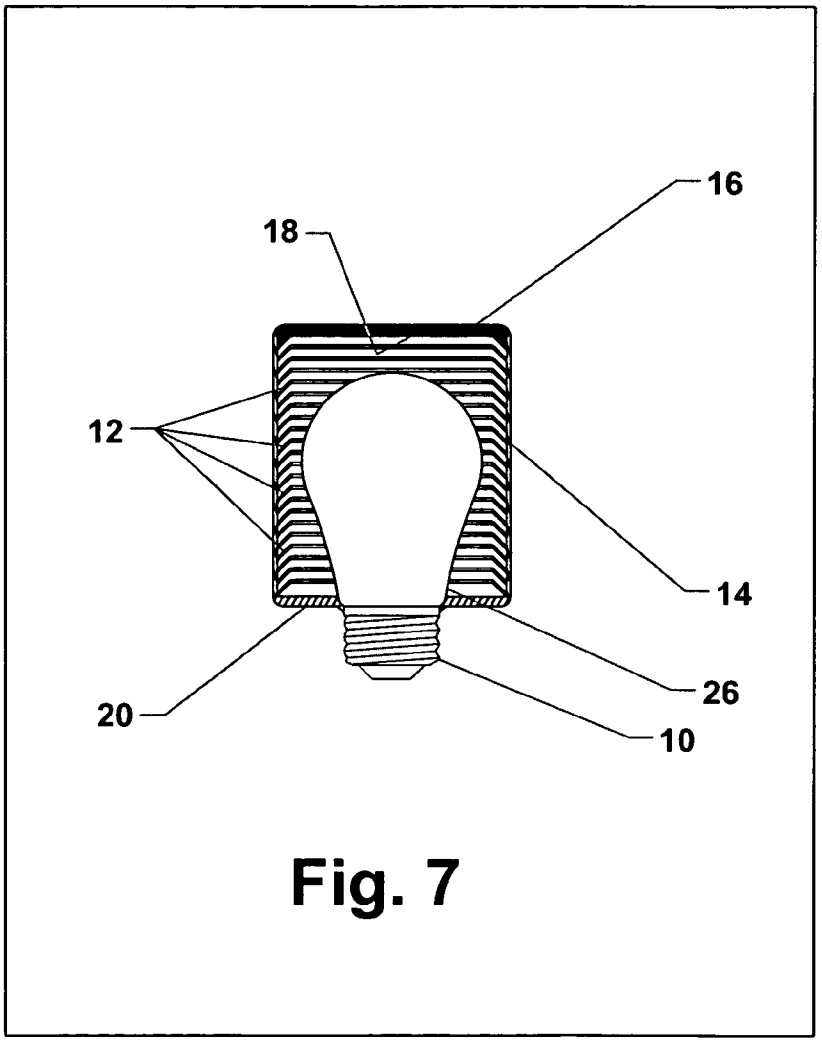
FIG. 7 shows a side view of the bulb of the present invention for an incandescent bulb for use in an upward facing fixture having 21 louvers.

Please refer to FIG. 1.

Bulb 10 is surrounded by a series of opaque, conical, louvers arranged in a circular configuration surrounding the bulb to direct the light emanating from the bulb to achieve full cut-off of the light not only in the horizontal and above direction but anywhere above a conical volume of space below the light fixture. The angle of that conical light volume is dependent upon the vertical spacing of the louvers. A cutoff of emitted light 10 degree to 20 degree below the horizontal plane would be typical. Multiple louvers are preferred over a single louver or shade to utilize the full light emission of the base bulb yet direct that full light emission where needed.

The louvers are surrounded by a transparent cylinder 14 and the transparent cylinder 14 is sealed with an upper end cap having an opaque exterior surface and a reflective interior surface and a transparent lower end cap.

Base light bulb 10 can be any bulb available. At the present time either a compact fluorescent bulb or an incandescent bulb can be utilized, but a light bulb technology may be developed which lends itself for use in the present invention. Any size bulb or wattage can be utilized in the device of the present invention depending upon illumination needs. Many makes of base light bulbs can be utilized, however, an example of such a compact fluorescent bulb may be procured from Royal Phillips Electronics, Amstelplein 2, Breitner Center, P.O. Box 77900, 1070 MX Amsterdam, The Netherlands. Base bulb 10 is surrounded by a plurality of fixed conical louvers 12 which encircle the bulb. Louvers 12 comprise thin opaque material which is coated with a low reflectivity coating 26.

For use in compact fluorescent bulb applications, low temperature materials can be used for louvers 12. Suitable low temperature louver materials include, for example, ABS plastic, polycarbonate or nylon. ABS, polycarbonate, or nylon and can be procured from Colorado Plastic Products, 1901 31$^{st}$ Street, Boulder, Colo. 80301.

For use in incandescent bulb applications, the louvers will be required to withstand higher temperatures. Suitable high temperature louver materials include, for example, stamped sheet metal such as AISI 1006 or molded polymer polyetheretherketone. Stamped sheet metal can be procured from Apex Distribution, 2322 Kalamath Street, Denver, Colo. 80223. Polyetheretherketone can be procured from Colorado Plastic Products, 1901 31$^{st}$ Street, Boulder, Colo. 80301.

The louvers 12 are opaque to prevent light transmission through the louver material. The louvers 12 are coated with a low reflectivity coating 25 to keep unwanted, reflected light from escaping above the light cut-off. Coating 26 will depend on the material used for the louvers. It is essential that the coating adhere to the louvers under a variety of climactic conditions. Suitable coatings include, but are not limited to: Aeroglaze Z306 flat, diffuse black coating available from LORD corporation, 2000 West Grandview Blvd., Erie, Pa. 16509-1029; Nextel flat black velvet paint (ECP-2200 Solar Absorber Coating, 3M 34-7016-8832-6) available from 3M Corporation, 3M Center, St. Paul, Minn. 55144-1000; Optilack, available from Tetenal AG & Co, KG, Schutzenwall 31-35, 22844 Norderstedt, Germany; Krylon™ ultra flat black paint, available from Aero Performance Coatings, 2520 Sycamore Street, Harrisburg, Pa. 17111; and Martin Black low-reflectivity coating available from Martin-Marietta Materials, 2710 Wycliff Road, Raleigh, N.C. 27607-3033.

The number and slope or angle of the louvers are variable and will depend upon the configuration of light bulb 10. The louver design is configured to achieve full cut-off of light above a cone approximately 10 to 20 degrees (typical) below the horizontal plane. The number of louvers shown in the drawings is 4, 10, 17 and 21, but any number of louvers can be utilized to achieve a full cut-off of light in the unwanted direction. The smaller the louvers, the greater the number of louvers will be required to achieve the desired result.

The louvers are surrounded by transparent cylinder 14. For use in compact fluorescent bulb applications, low temperature materials can be used for transparent cylinder 14. Suitable low temperature transparent cylinder materials include, for example, ABS plastic, polycarbonate or transparent nylon. ABS, polycarbonate, or transparent nylon can be procured from Colorado Plastic Products, 1901 31st Street, Boulder, Colo. 80301.

For use in incandescent bulb applications, the transparent cylinder 14 will be required to withstand higher temperatures. Suitable high temperature transparent cylinder materials include, for example, quartz glass, borosilicate glass or polymer polyetheretherketone. Quartz glass and borosilicate glass can be procured from Technical Glass Products, Inc, 881 Callendar Blvd., Painesville, Twp., Ohio 44077. Polyetheretherketone can be procured from Colorado Plastic Products, 1901 31st Street, Boulder, Colo. 80301.

Transparent cylinder 14 is sealed with an upper end cap having an opaque exterior surface and a reflective interior surface. The opacity of the upper end cap can be achieved by using an opaque material or utilizing the same opaque coating utilized for the surface of the louvers, for example, or any other means of accomplishing opacity. The interior surface of the upper end cap is mirrored to achieve a highly reflective coating directing light downward. Mirrored surface coating 18 can be achieved by many means. One such method is to apply a mirror coating by evaporative deposition techniques. Ion beam sputtering can also be utilized to achieve a mirrored coating. Evaporative coatings are available from Evaporative Coatings, Inc., 2365 Maryland Road, Willow Grove, Pa. 19090.

FIGS. 1, 3, 5, and 7 show upper cap 16 for upward facing bulbs. FIGS. 2, 4, 6, and 8 show upper cap 24 for downward facing bulbs. Upper cap 24 has a circular hole in it to accommodate the base of the light bulb 10. Upper cap 24 also provides a structural connection between the base of the bulb 10 and the louvers 12. This structural connection may be achieved through the use of adhesives or the cap may be incorporated into the construction of the base of the bulb.

The lower end of transparent cylinder 14 is sealed with a transparent lower cap to allow maximum possible light transmission in the downward direction. FIGS. 1, 3, 5, and 7 show lower cap 20 for upward facing bulbs. Lower cap 20 has a circular hole in it to accommodate the base of the light bulb 10. Lower cap 20 also provides a structural connection between the base of the bulb 10 to louvers 12.

FIGS. 2, 4, 6, and 8 show lower cap 22 for downward facing bulbs. Transparent cylinder 14 is sealed to the lower cap and upper cap to prevent the ingress of insects, dirt or water vapor into the bulb assembly. This seal may be accomplished with adhesives, a threaded joint or a snap fit.

Figure 9:
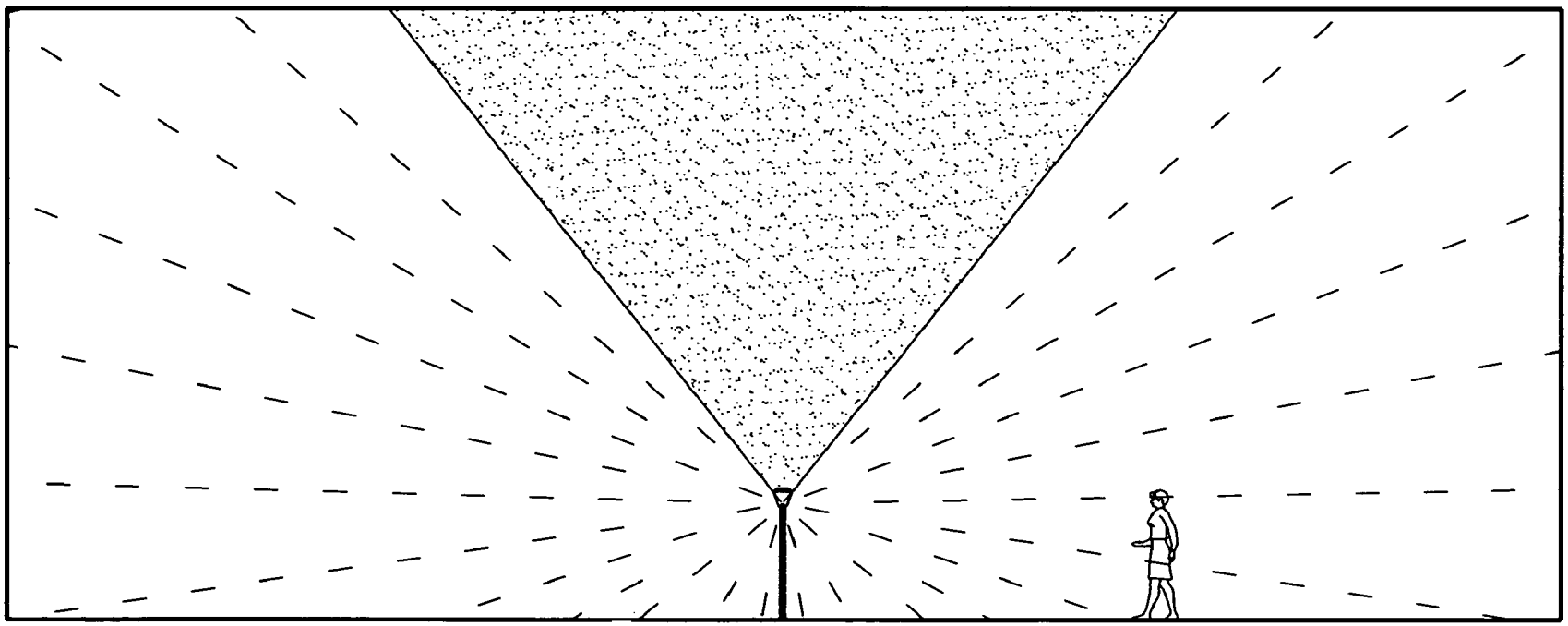
FIG. 9 shows the effect of a prior art, or unshielded light bulb in an upward facing fixture showing light pollution. The stipple represents darkness.

FIG. 9 shows a typical upward facing fixture having a "prior art" bulb in it which allows light pollution. The stipple represents darkness. It is apparent that a great deal of light escapes above the horizontal plane of the bulb and is unnecessarily illuminating the sky. Energy is wasted by uselessly illuminating the sky.

Figure 10:
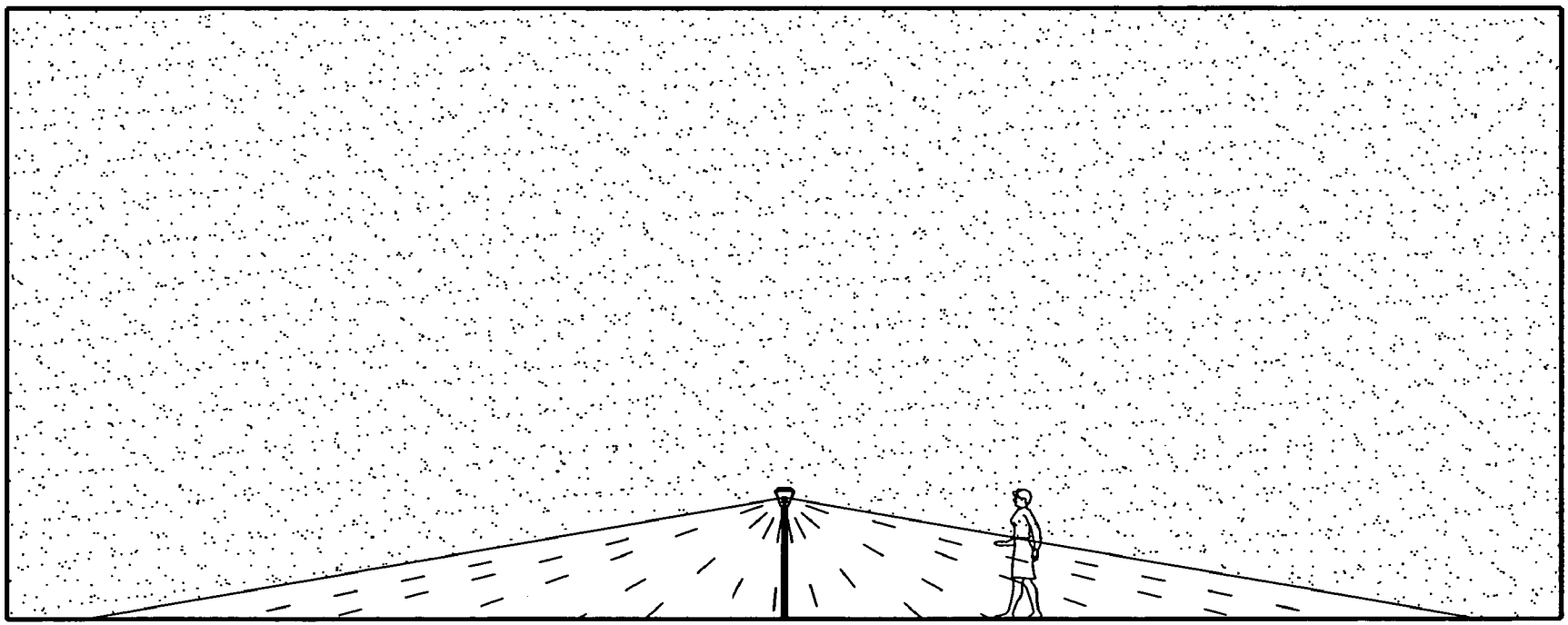
FIG. 10 shows the effect of the bulb of the present invention in an upward facing fixture showing no light pollution. The stipple represents darkness.

FIG. 10 shows the same fixture as in FIG. 9 equipped with a bulb of the present invention. The light is well contained below the horizontal plane and darkness is preserved. Energy is conserved by reducing the necessary bulb wattage and directing the reduced light where needed, maintaining comparable nighttime visibility at ground level.

Figure 11:
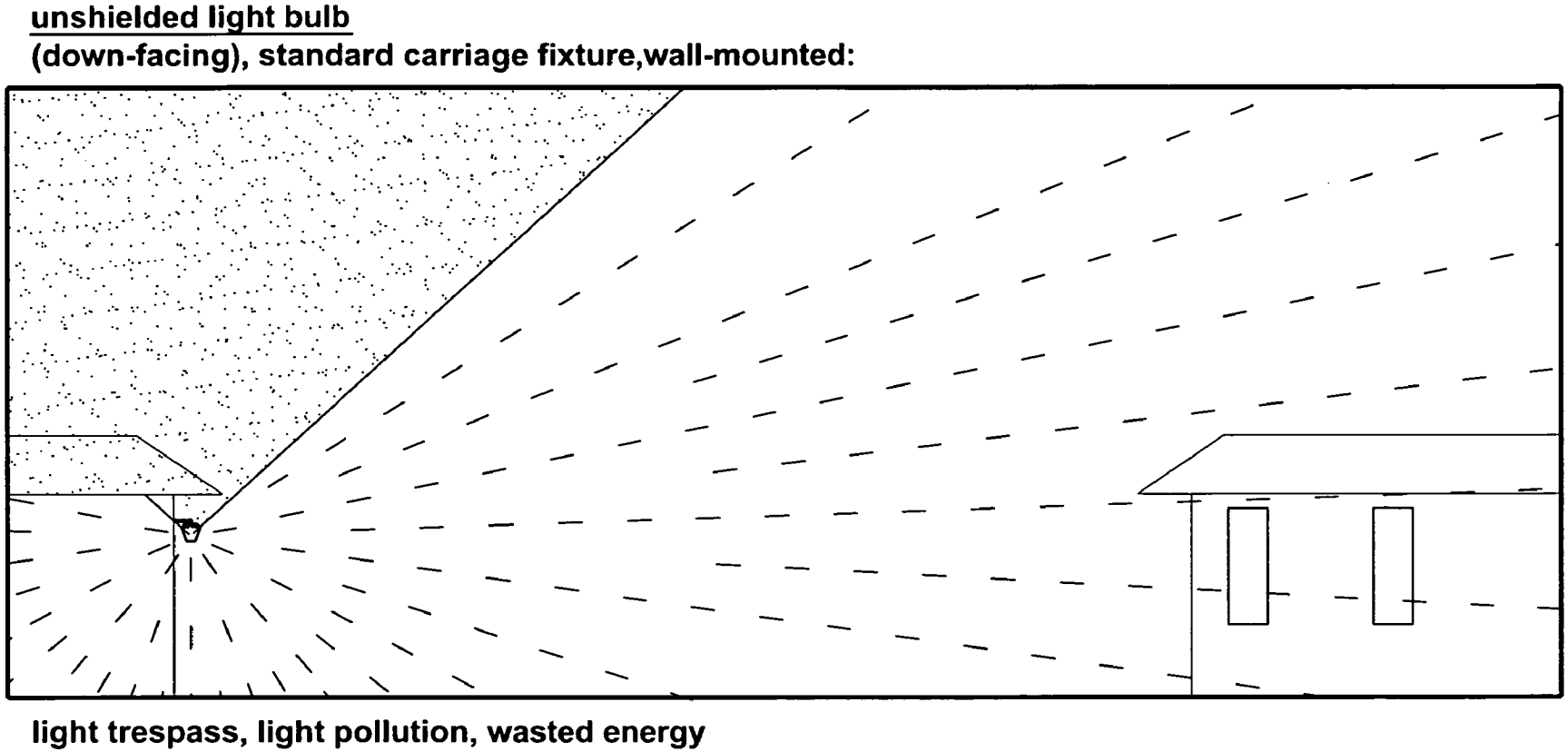
FIG. 11 shows the effect of a prior art, or unshielded light bulb in a downward facing fixture showing light pollution. The stipple represents darkness.

FIG. 11 shows a typical downward facing fixture attached to the side of a building having a "prior art" bulb in it which allows light pollution. It is apparent that a great deal of light escapes above the horizontal plane of the bulb and is unnecessarily illuminating the sky. Once again, energy is wasted by uselessly illuminating the sky.

Figure 12:
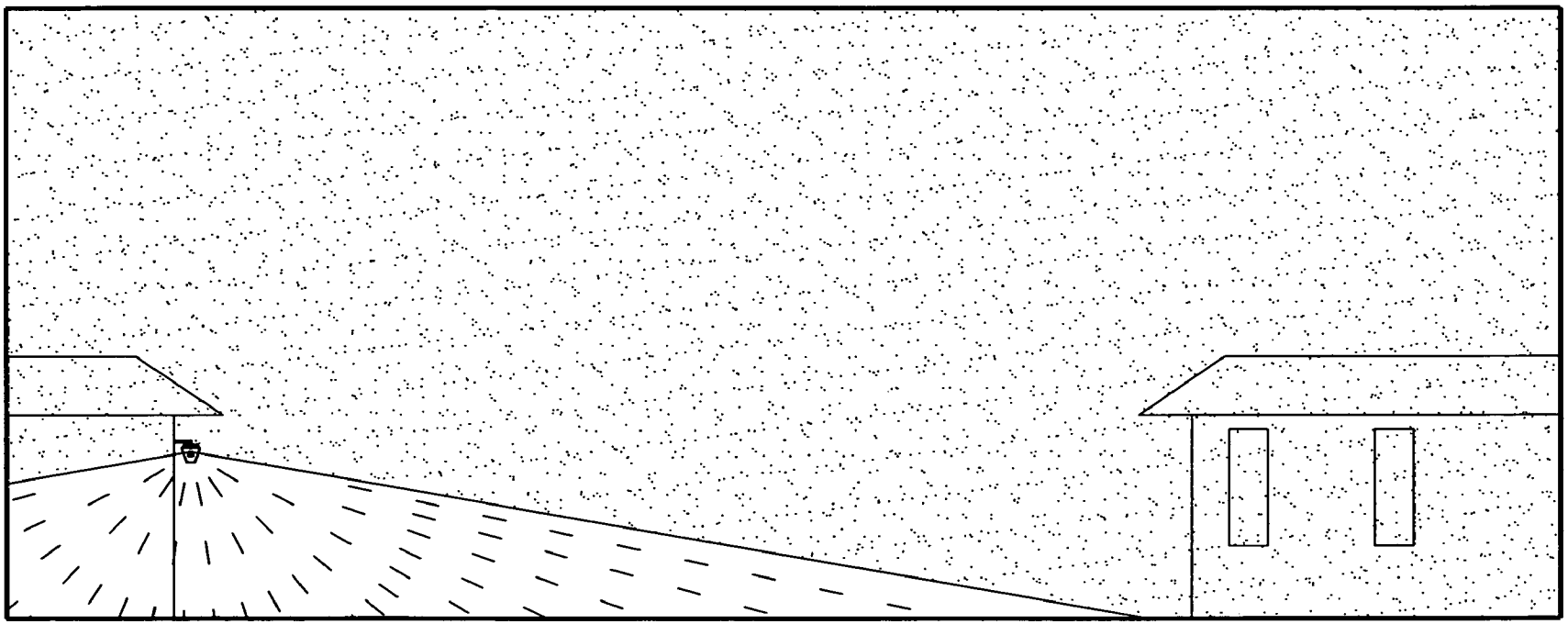
FIG. 12 shows the effect of the bulb of the present invention in a downward facing fixture showing no light pollution. The stipple represents darkness.

FIG. 12 shows the same fixture as in FIG. 11 equipped with a bulb of the present invention. The light is well contained below the horizontal plane and darkness is preserved. Energy is conserved by reducing the necessary bulb wattage and directing the reduced light where needed, maintaining comparable nighttime visibility at ground level.

Figure 13:
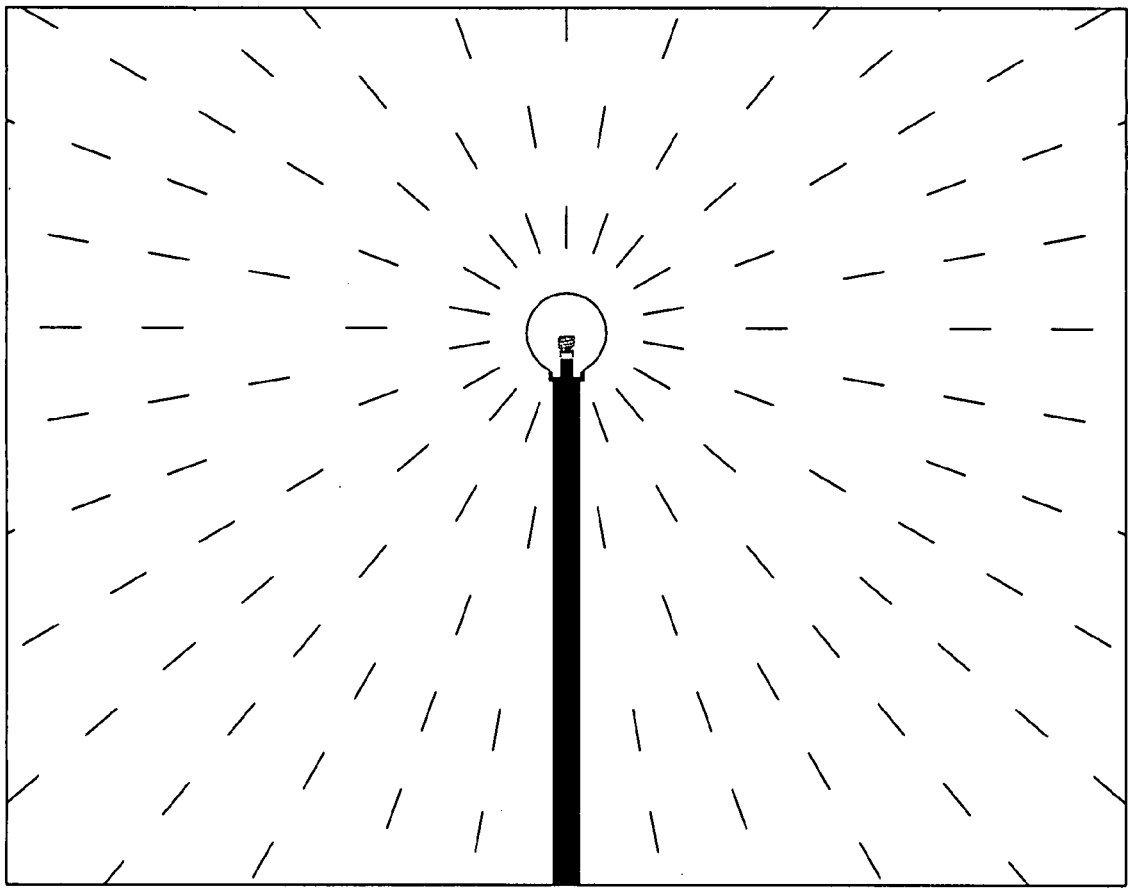
FIG. 13 shows the effect of a prior art, or unshielded light bulb in an upward facing globe fixture showing light pollution.

FIG. 13 shows a typical upward facing globe fixture on a lamp post having a "prior art" bulb in it which allows light pollution. Once again, it is apparent that a great deal of light escapes above the horizontal plane of the bulb and is unnecessarily illuminating the sky. Energy is again wasted.

Figure 14:
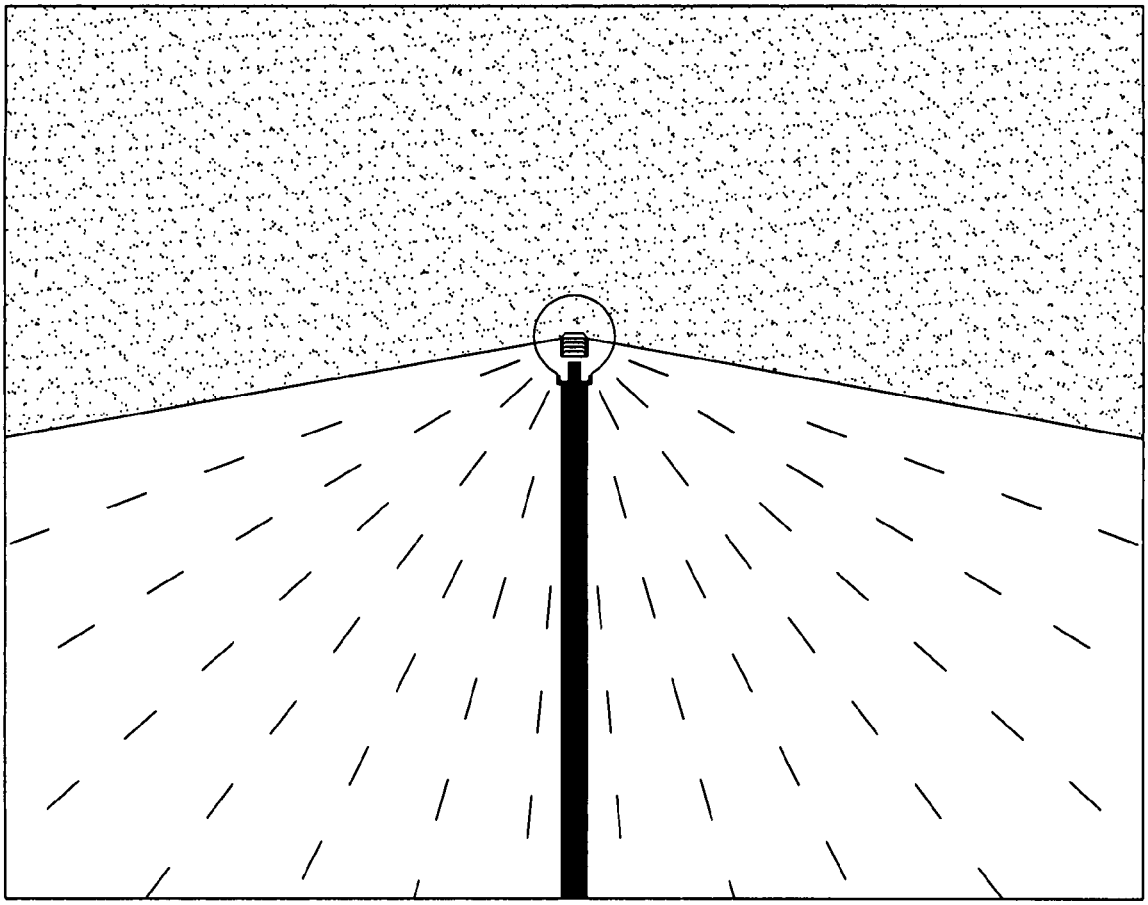
FIG. 14 shows the effect of the bulb of the present invention in an upward facing globe fixture showing no light pollution. The stipple represents darkness.

FIG. 14 shows the same fixture as in FIG. 13 equipped with a bulb of the present invention. The light is well contained below the horizontal plane and darkness is preserved. Energy is conserved by reducing the necessary bulb wattage and directing the reduced light where needed maintaining comparable nighttime visibility at ground level.

Figure 15:
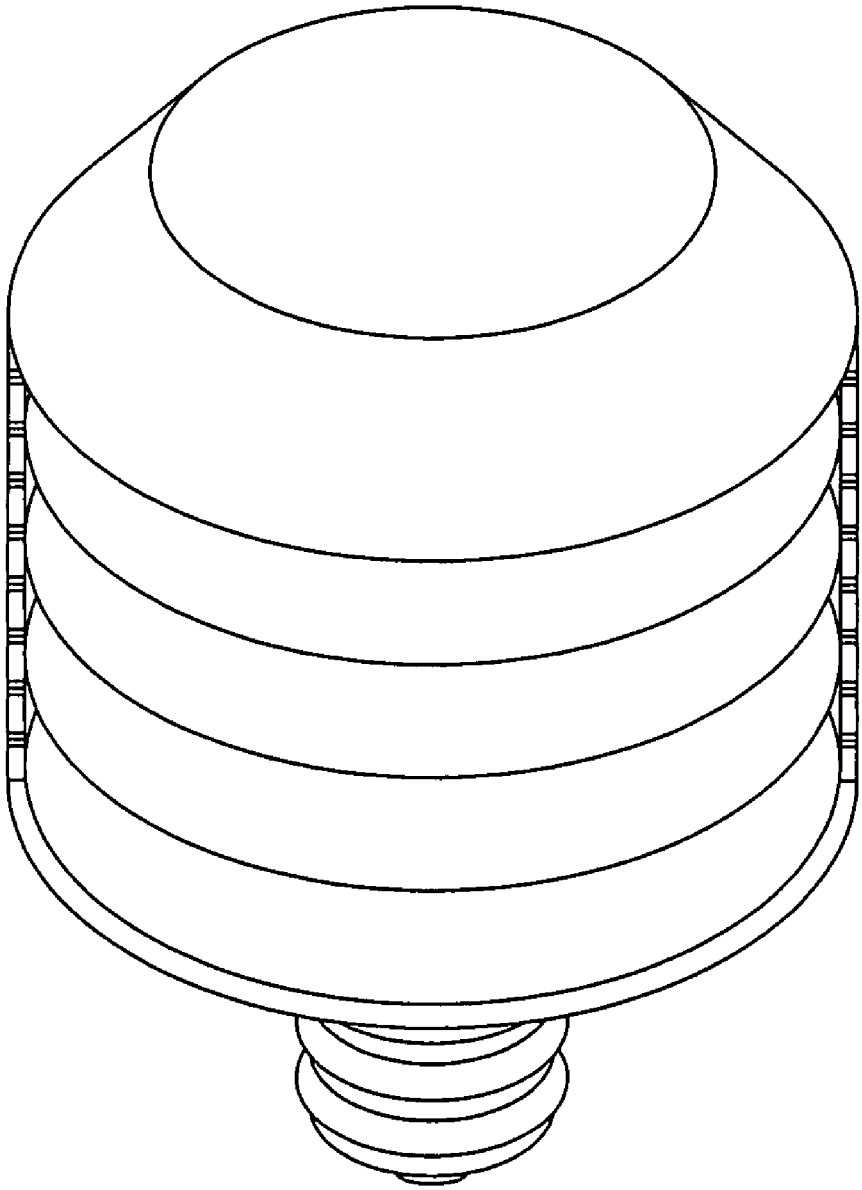
FIG. 15 shows a perspective view of the bulb of the present invention.

FIG. 15 shows a perspective view of the bulb of the present invention.

It is clear from the foregoing that the device of the present invention provides a simple and elegant solution to the increasing problems of light pollution and light trespass. Additionally, the present invention is superior to any prior art device. The sealed, self-contained, shielded bulb assembly of the present invention can be economically manufactured and can be installed by the consumer in almost any standard electrical light fixture to transform that standard fixture into a full light cut-off, light pollution-free fixture. And, in doing so, comply with expanding municipal lighting codes regarding light pollution/light trespass without undue expense.

Although this invention has been described with respect to specific embodiments, it is not intended to be limited thereto and various modifications which will become apparent to the person of ordinary skill in the art are intended to fall within the spirit and scope of the invention as described herein taken in conjunction with the accompanying drawings and the appended claims.

The invention claimed is:

1. A self-contained bulb assembly for providing a full light cut-off light pollution free bulb comprising:

a. not more than one light bulb;

b. multiplicity of fixed conical louvers arranged in circular configuration surrounding the bulb for directing light and wherein the louvers are essentially parallel to one another; and c. a transparent cylinder for encasing and protecting the louvers.

2. The self-contained bulb assembly of claim 1 wherein the light bulb is a compact fluorescent light bulb.

3. The bulb assembly of claim 2 further comprising an opaque upper cap.

4. The bulb assembly of claim 2 further comprising a transparent lower cap.

5. The bulb assembly of claim 2 wherein louvers are opaque.

6. The bulb assembly of claim 5 wherein louvers are coated with an anti-reflective surface coating.

7. The bulb assembly of claim 3 wherein inside surface of upper cap comprises a reflective surface.

8. The bulb assembly of claim 2 wherein the multiplicity of louvers is any number of louvers to achieve light cut-off above the horizontal direction; above the top of the bulb.

9. The bulb assembly of claim 8 wherein the number of louvers is selected from the group consisting of: 4, 10, 17 and 21.

10. The bulb assembly of claim 2 wherein louvers are oriented in a downward facing direction for a downward facing bulb assembly.

11. The self-contained bulb assembly of claim 1 for providing a full light cut-off light pollution free bulb wherein the light bulb is an incandescent light bulb.

12. The bulb assembly of claim 11 further comprising an opaque upper cap.

13. The bulb assembly of claim 11 further comprising a transparent lower cap.

14. The bulb assembly of claim 11 wherein louvers are opaque.

15. The bulb assembly of claim 14 wherein louvers are coated with an anti-reflective surface coating.

16. The bulb assembly of claim 12 wherein the inside surface of the upper cap further comprises a reflective surface.

17. The bulb assembly of claim 11 wherein multiplicity of louvers is any number of louvers to achieve light cut-off above the horizontal direction above the top of the bulb.

18. The bulb assembly of claim 17 wherein the number of louvers is selected from the group consisting of: 4, 10, 17 and 21.

19. The bulb assembly of claim 2 wherein the louvers are constructed of material selected from the group consisting of:

ABS plastic, polycarbonate, nylon and molded polymer polyetheretherketone.

20. The bulb assembly of claim 11 wherein the louvers are constructed of material selected from the group consisting of stamped sheet metal, and polymer polyetheretherketone.

21. The bulb assembly of claim 2 wherein the transparent cylinder is constructed of material selected from the group consisting of ABS plastic, polycarbonate, polyetheretherketone and transparent nylon.

22. The bulb assembly of claim 11 wherein the transparent cylinder is constructed of material selected from the group consisting of quartz glass, borosilicate glass, and polymer polyetheretherketone.

* * * * *